US012618224B2

(12) United States Patent
Muraoka et al.

(10) Patent No.: US 12,618,224 B2
(45) Date of Patent: May 5, 2026

(54) ELECTRIC WORK MACHINE

(71) Applicant: Yanmar Holdings Co., Ltd., Osaka (JP)

(72) Inventors: Hiroyuki Muraoka, Fukuoka (JP); Mitsuyuki Hatanaka, Fukuoka (JP)

(73) Assignee: Yanmar Holdings Co., Ltd., Osaka (JP)

( * ) Notice: Subject to any disclaimer, the term of this patent is extended or adjusted under 35 U.S.C. 154(b) by 277 days.

(21) Appl. No.: 18/380,017

(22) Filed: Oct. 13, 2023

(65) Prior Publication Data

US 2024/0133156 A1 Apr. 25, 2024
US 2024/0229417 A9 Jul. 11, 2024

(30) Foreign Application Priority Data

Oct. 20, 2022 (JP) ..... 2022-168257

(51) Int. Cl.
*E02F 9/08* (2006.01)

(52) U.S. Cl.
CPC ..... *E02F 9/0866* (2013.01); *E02F 9/0883* (2013.01)

(58) Field of Classification Search
CPC ..... E02F 9/0866; E02F 9/0883
See application file for complete search history.

(56) References Cited

U.S. PATENT DOCUMENTS 9,550,659 B2 1/2017 Nakazawa et al.
2022/0145587 A1* 5/2022 Takeo ..... E02F 9/2217

FOREIGN PATENT DOCUMENTS

CN 102713084 A * 10/2012 ..... E02F 9/0866
JP 2006069357 A 3/2006
JP 2011241587 A 12/2011
JP 4859859 B2 1/2012

OTHER PUBLICATIONS

Notice of Reasons for Refusal: Patent Application No. JP2022-168257, Date: Oct. 10, 2025.

* cited by examiner

*Primary Examiner* — Edwin A Young
(74) *Attorney, Agent, or Firm* — Chris Mizumoto

(57) ABSTRACT

A hydraulic excavator as an electric work machine includes: an electric motor; a battery unit that stores electric power for driving the electric motor; a hydraulic oil tank that contains hydraulic oil, and a hydraulic pump that is driven by the electric motor and connected to the hydraulic oil tank. The electric motor, the hydraulic pump, and the hydraulic oil tank are arranged below the battery unit on a machine body frame, and are arranged side by side in a lateral direction of the machine body frame.

10 Claims, 6 Drawing Sheets

ELECTRIC WORK MACHINE

CROSS-REFERENCE

This application claims foreign priority of JP2022-168257 filed Oct. 20, 2022, the disclosures of which are hereby incorporated by reference in their entirety.

TECHNICAL FIELD

The present invention relates to an electric work machine.

BACKGROUND ART

Conventionally, an electric work machine including an electric motor and a hydraulic pump has been proposed. For example, Patent Document 1 discloses an electric work machine in which an electric motor and a hydraulic pump are arranged below a battery unit that supplies electric power to the electric motor.

PRIOR ART DOCUMENT

Patent Document

Patent Document 1: Japanese Unexamined Patent Application Publication No. 2022-97079

SUMMARY OF INVENTION

Technical Problem

The hydraulic pump is driven by the electric motor and pumps hydraulic oil to a hydraulic actuator. The hydraulic oil is contained in a hydraulic oil tank. In a configuration of Patent Document 1, the hydraulic oil tank is arranged on a side of the battery unit. Therefore, there is room for improvement in achieving a layout suitable for a small-sized electric work machine, i.e., a compact layout including the hydraulic oil tank and the battery unit. In particular, even when the battery unit is increased in size in order to increase a capacity of the battery unit in a small-sized electric work machine, it is necessary to secure a space for arranging the hydraulic oil tank separately from the battery unit in the configuration of Patent Document 1. For this reason, it is more difficult to achieve the compact layout, and it may become difficult to increase the capacity of the battery unit.

In addition, when the electric motor and the hydraulic pump are driven, heat is generated, and the hydraulic oil flowing through the hydraulic actuator also reaches a high temperature and therefore, the hydraulic oil tank that contains the hydraulic oil also reaches a high temperature. In order to ensure cooling performance of the electric motor, the hydraulic pump, and the hydraulic oil tank, it is desirable to achieve a layout which also takes into consideration cooling efficiency in cooling these components.

The present invention has been made in order to solve the above problems, and an object of the present invention is to provide an electric work machine that has a compact layout and facilitates an increase in capacity of a battery unit while also taking into consideration the cooling efficiency in cooling an electric motor, a hydraulic pump, and a hydraulic oil tank.

Solution to Problem

An electric work machine according to one aspect of the present invention includes an electric motor, a battery unit that stores electric power for driving the electric motor, a hydraulic oil tank that contains hydraulic oil, and a hydraulic pump that is driven by the electric motor and is connected to the hydraulic oil tank, where the electric motor, the hydraulic pump, and the hydraulic oil tank are arranged below the battery unit on a machine body frame and are arranged side by side in a lateral direction of the machine body frame.

Advantageous Effects of Invention

It is possible to achieve an electric work machine that has a compact layout and facilitates an increase in capacity of the battery unit while also taking into consideration cooling efficiency when cooling the electric motor, the hydraulic pump, and the hydraulic oil tank.

DESCRIPTION OF EMBODIMENTS

An embodiment of the present invention will be described as follows with reference to the drawings.

1. Electric Work Machine

Figure 1:
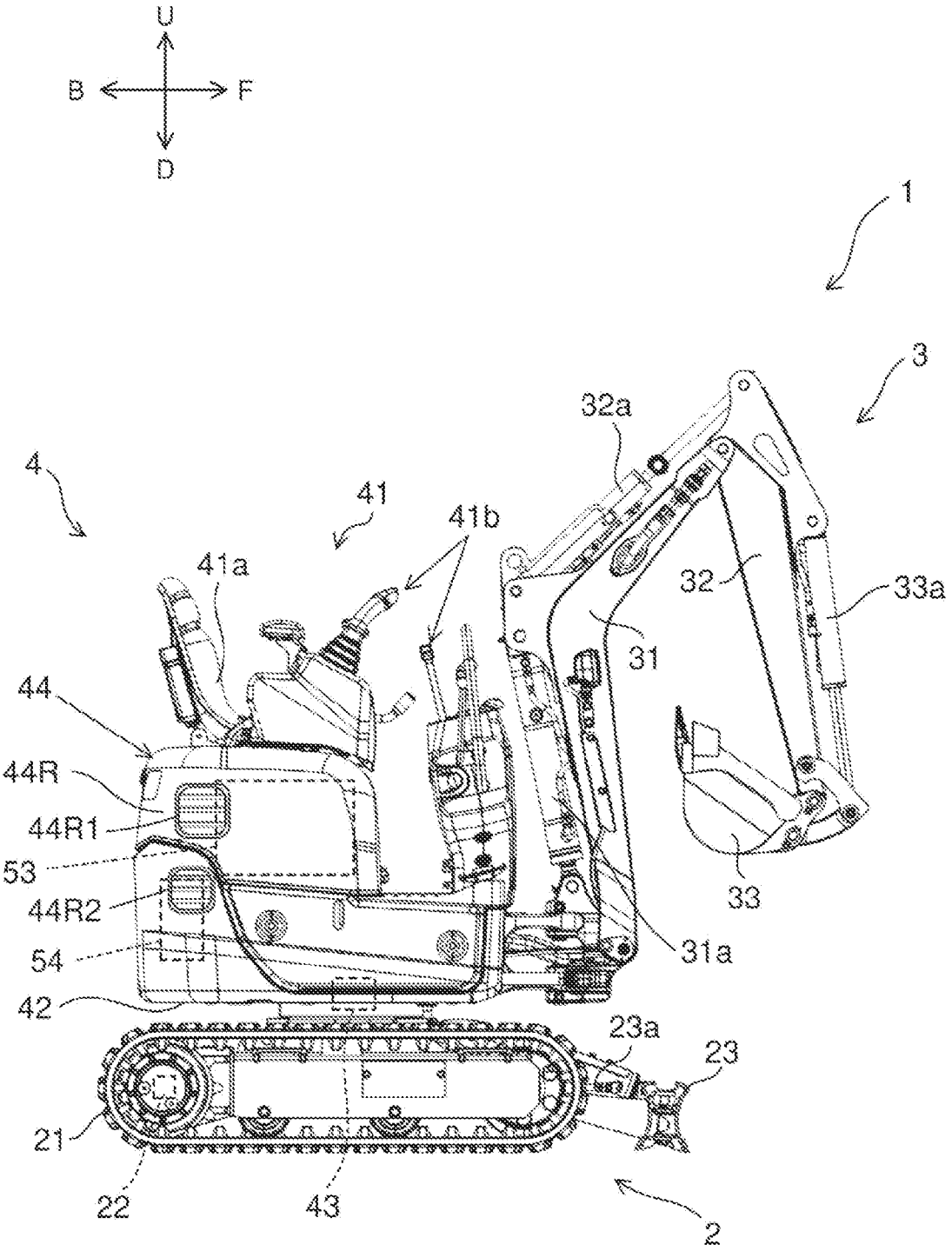
FIG. 1 is a side view illustrating a schematic configuration of a hydraulic excavator provided as an example of an electric work machine according to one embodiment of the present invention.
Figure 2:
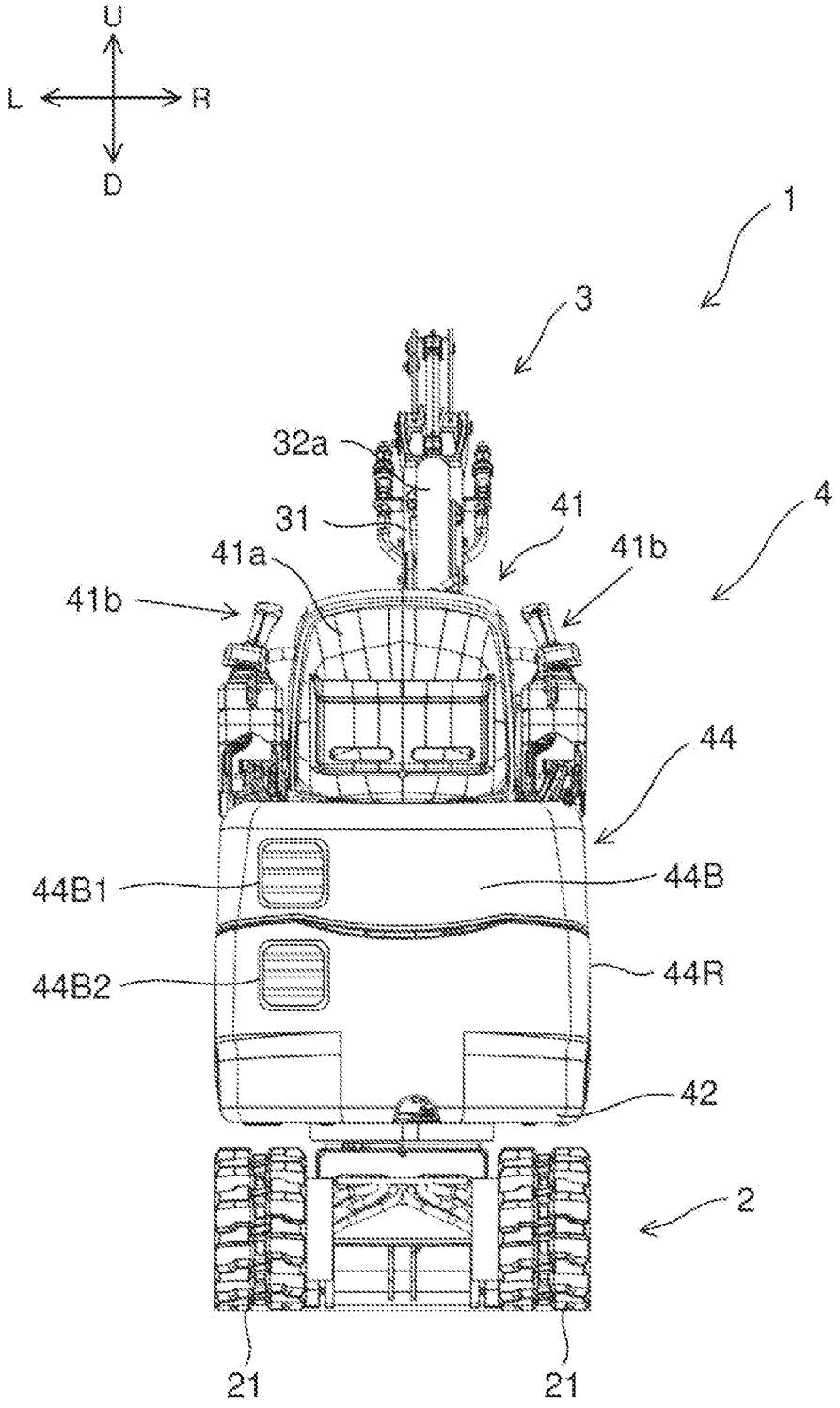
FIG. 2 is a rear view of the above-mentioned hydraulic excavator.

FIG. 1 is a side view illustrating a schematic configuration of a hydraulic excavator (electric excavator) 1 provided as an example of an electric work machine according to the present embodiment. FIG. 2 is a rear view of the hydraulic excavator 1. The hydraulic excavator 1 includes a lower traveling body 2, a work machine 3, and an upper turning body 4.

Here, in this embodiment, each direction is defined as follows. A forward direction is a direction in which an operator (manipulator, driver) seated on a driver seat 41*a* of the upper turning body 4 faces front, and a backward direction is a direction opposite to the forward direction. Therefore, in a state where the upper turning body 4 does not turn with respect to the lower traveling body 2 (0 degree turning angle), a front-back direction of the upper turning body 4 coincides with a direction in which the lower traveling body 2 moves forward and backward. As viewed from the operator seated on the driver seat 41*a*, a left side is defined as "left" and a right side is defined as "right". A gravity direction perpendicular to the front-back direction and a left-right direction is defined as an up-down direction, in which an upstream side of the gravity direction is defined as "up", and a downstream side thereof is defined as "down". In the drawings, the hydraulic excavator 1 is illustrated in a state where the upper turning body 4 does not turn with respect to the lower traveling body 2. Further, in the drawings, as necessary, a forward is denoted by a symbol "F", likewise, backward by "B", rightward by "R", leftward by "L", upward by "U", and downward by "D".

The lower traveling body 2 includes a pair of left and right crawlers 21 and a pair of left and right traveling motors 22. Each of the traveling motors 22 is a hydraulic motor. The left and right traveling motors 22 drive the left and right crawlers 21, respectively, thereby allowing the hydraulic excavator 1 to move forward and backward. The lower traveling body 2 is provided with a blade 23 for performing a ground leveling work and a blade cylinder 23*a*. The blade cylinder 23*a* is a hydraulic cylinder that rotates the blade 23 in the up-down direction.

The work machine 3 includes a boom 31, an arm 32, and a bucket 33. The boom 31, the arm 32, and the bucket 33 can be independently driven, thereby enabling to perform excavation work of earth, sand, and the like.

The boom 31 is rotated by a boom cylinder 31*a*. The boom cylinder 31*a* has a base end portion thereof supported by a front portion of the upper turning body 4, and is movable freely in an extendable and retractable manner. The arm 32 is rotated by an arm cylinder 32*a*. The arm cylinder 32*a* has a base end portion thereof supported by the boom 31, and is movable freely in an extendable and retractable manner. The bucket 33 is rotated by a bucket cylinder 33*a*. The bucket cylinder 33*a* has a base end portion thereof supported by the arm 32, and is movable freely in an extendable and retractable manner.

The boom cylinder 31*a*, the arm cylinder 32*a*, and the bucket cylinder 33*a* each include a hydraulic cylinder.

The upper turning body 4 is located above the lower traveling body 2 and provided capable of turning with respect to the lower traveling body 2 via a turning bearing (not illustrated). In the upper turning body 4, a steering unit 41, a turning frame 42, a turning motor 43, and an engine room 44 are arranged. By driving of the turning motor 43 as a hydraulic motor, the upper turning body 4 turns via a turning bearing. The hydraulic excavator 1 includes the turning frame 42 as a machine body frame.

The upper turning body 4 includes a hydraulic pump 71 (see FIG. 3) arranged. Namely, the hydraulic excavator 1 includes the hydraulic pump 71. The hydraulic pump 71 is driven by an electric motor 61 (see FIG. 3, etc.) inside the engine room 44. The hydraulic pump 71 supplies a hydraulic oil (pressure oil) to hydraulic motors (for example, the left and right traveling motors 22 and the turning motor 43), and hydraulic cylinders (for example, the blade cylinder 23*a*, the boom cylinder 31*a*, the arm cylinder 32*a*, and the bucket cylinder 33*a*). The hydraulic motors and the hydraulic cylinders that are driven with the hydraulic oil supplied from the hydraulic pump 71 are collectively referred to as a hydraulic actuator 73 (see FIG. 3).

The steering unit 41 is installed on the turning frame 42. The driver seat 41*a* is arranged on the steering unit 41. Various levers 41*b* are arranged around the driver seat 41*a*. The operator is seated on the driver seat 41*a* and operates the lever 41*b*, thereby driving the hydraulic actuator 73. This allows the lower traveling body 2 to travel, the blade 23 to perform a ground leveling work, the work machine 3 to perform an excavation work, the upper turning body 4 to turn, and the like.

A battery unit 53 is arranged on the upper turning body 4. Namely, the hydraulic excavator 1 includes the battery unit 53. The battery unit 53 is composed of, for example, a lithium-ion battery unit, and stores electric power for driving the electric motor 61. The battery unit 53 may be composed of a plurality of batteries as a unit or may be composed of a single battery cell. In the present embodiment, the battery unit 53 is composed of three batteries as a unit (see FIG. 5), but the number of batteries to be unitized is not limited to the above three.

Moreover, the upper turning body 4 is provided with a power feed port, which is not illustrated. The above-mentioned power feed port and an external power source (commercial power source) are connected via a power feed cable. This allows charging of the battery unit 53.

The upper turning body 4 is further provided with a lead battery 54. The lead battery 54 outputs a low voltage (12 V, for example) DC voltage. The output from the lead battery 54 is supplied as a control voltage to, for example, a system controller 67 (see FIG. 3), a drive unit of a fan 81 (see FIG. 5), and the like.

The hydraulic excavator 1 may be configured by using hydraulic equipment such as the hydraulic actuator 73 and an actuator driven by electric power, in combination. As the actuator driven by electric power, for example, an electric traveling motor, an electric cylinder, and an electric turning motor are included.

2. Configuration of Electric System and Hydraulic System

Figure 3:
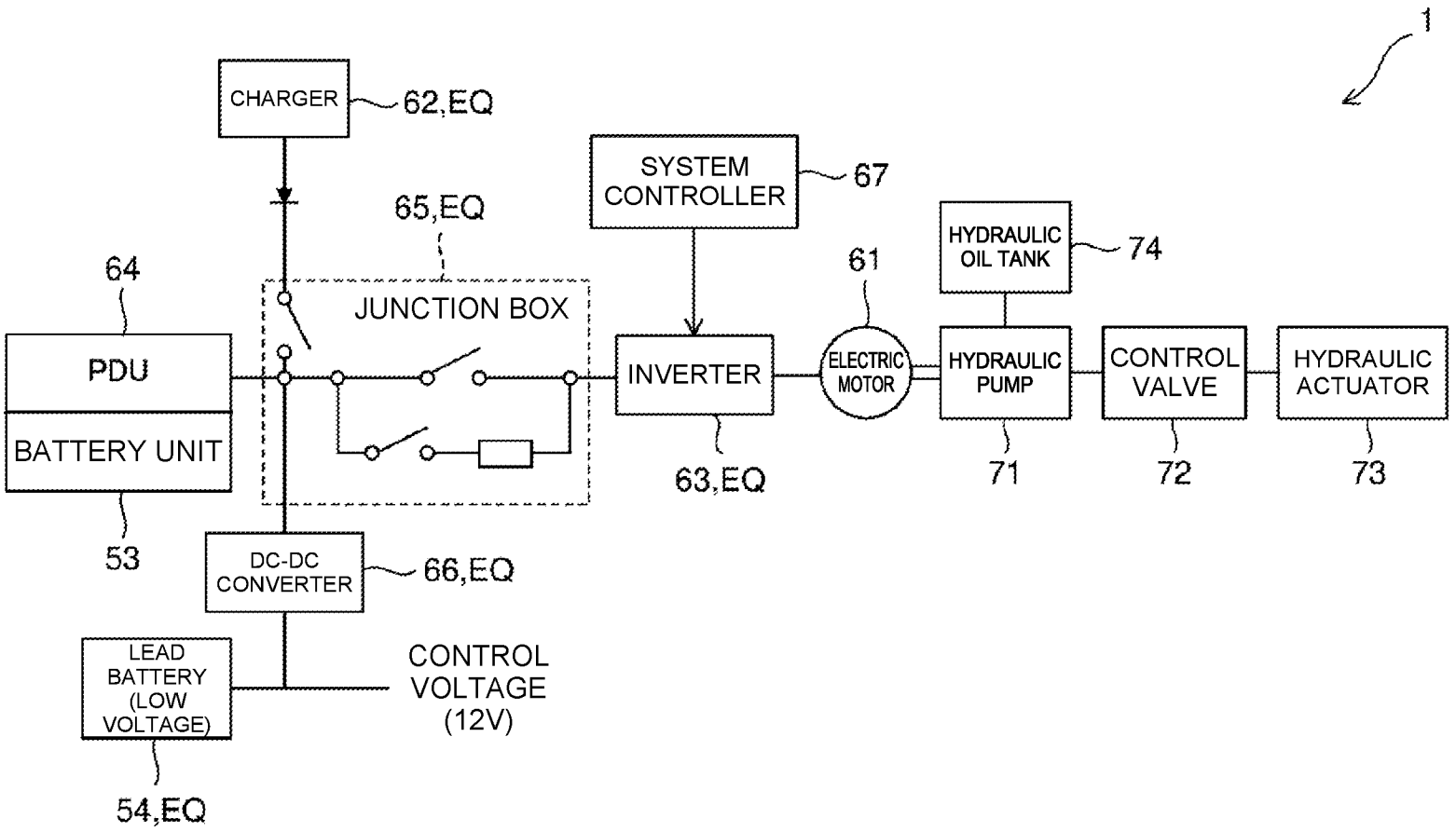
FIG. 3 is a block diagram schematically illustrating a configuration of an electric system and a hydraulic system of the above-mentioned hydraulic excavator.

FIG. 3 is a block diagram schematically illustrating a configuration of electric and hydraulic systems of the hydraulic excavator 1. The hydraulic excavator 1 includes the electric motor 61, a charger 62, an inverter 63, and a Power Drive Unit (PDU) 64, a junction box 65, a DC-DC converter 66, and a system controller 67. The system controller 67 is composed of an electronic control unit also called an Electronic Control Unit (ECU) and electrically controls each unit of the hydraulic excavator 1. The charger 62, the inverter 63, the junction box 65, the DC-DC converter 66, and the above-mentioned lead battery 54 are also collectively referred to as electrical equipment EQ.

The electric motor 61 is driven by electric power supplied from the battery unit 53 via the junction box 65 and the inverter 63. The electric motor 61 is composed of a permanent magnet motor or an induction motor. The electric motor 61 is arranged (vibration-isolation supported) above the turning frame 42 (see FIG. 1).

The charger 62 converts an AC voltage supplied from the external power source via the power feed cable into a DC voltage. The inverter 63 converts a DC voltage supplied from the battery unit 53 into an AC voltage and supplies the AC voltage to the electric motor 61. This rotates the electric motor 61. The AC voltage (current) from the inverter 63 to the electric motor 61 is supplied based on a rotation instruction being output from the system controller 67.

The PDU 64 is a battery control unit that controls input and output of the battery unit 53 by controlling an internal battery relay, and is also called a power management unit (PMU). The junction box 65 is configured by including a charger relay, an inverter relay, a fuse, and the like. The voltage being output from the above-mentioned charger 62 is supplied to the battery unit 53 via the junction box 65 and the PDU 64. The voltage being output from the battery unit 53 is supplied to the inverter 63 via the PDU 64 and the junction box 65.

The DC-DC converter 66 lowers a high-voltage (300 V, for example) DC voltage supplied from the battery unit 53 via the junction box 65 to a low voltage (12 V, for example). Similar to the output from the lead battery 54, the voltage being output from the DC-DC converter 66 is supplied to the system controller 67, the drive unit of the fan 81, and the like. In the present embodiment, a plurality of the DC-DC converters 66 are provided (see FIG. 5), but a single DC-DC converter 66 may be provided.

The hydraulic pump 71 is connected to a rotary shaft (output shaft) of the electric motor 61. The hydraulic pump 71 is connected to a hydraulic oil tank 74 that contains (stores) hydraulic oil via a hydraulic hose 75 (see FIGS. 5 and 6). Namely, the hydraulic excavator 1 includes the hydraulic oil tank that contains hydraulic oil. The hydraulic pump 71 causes the hydraulic oil in the hydraulic oil tank 74 to be supplied to the hydraulic actuator 73 via a control valve 72. As a result, the hydraulic actuator 73 is driven. The control valve 72 is a direction switch valve that controls a flow direction and a flow rate of the hydraulic oil supplied to the hydraulic actuator 73.

3 Configuration of Inside of Engine Room

Figure 4:
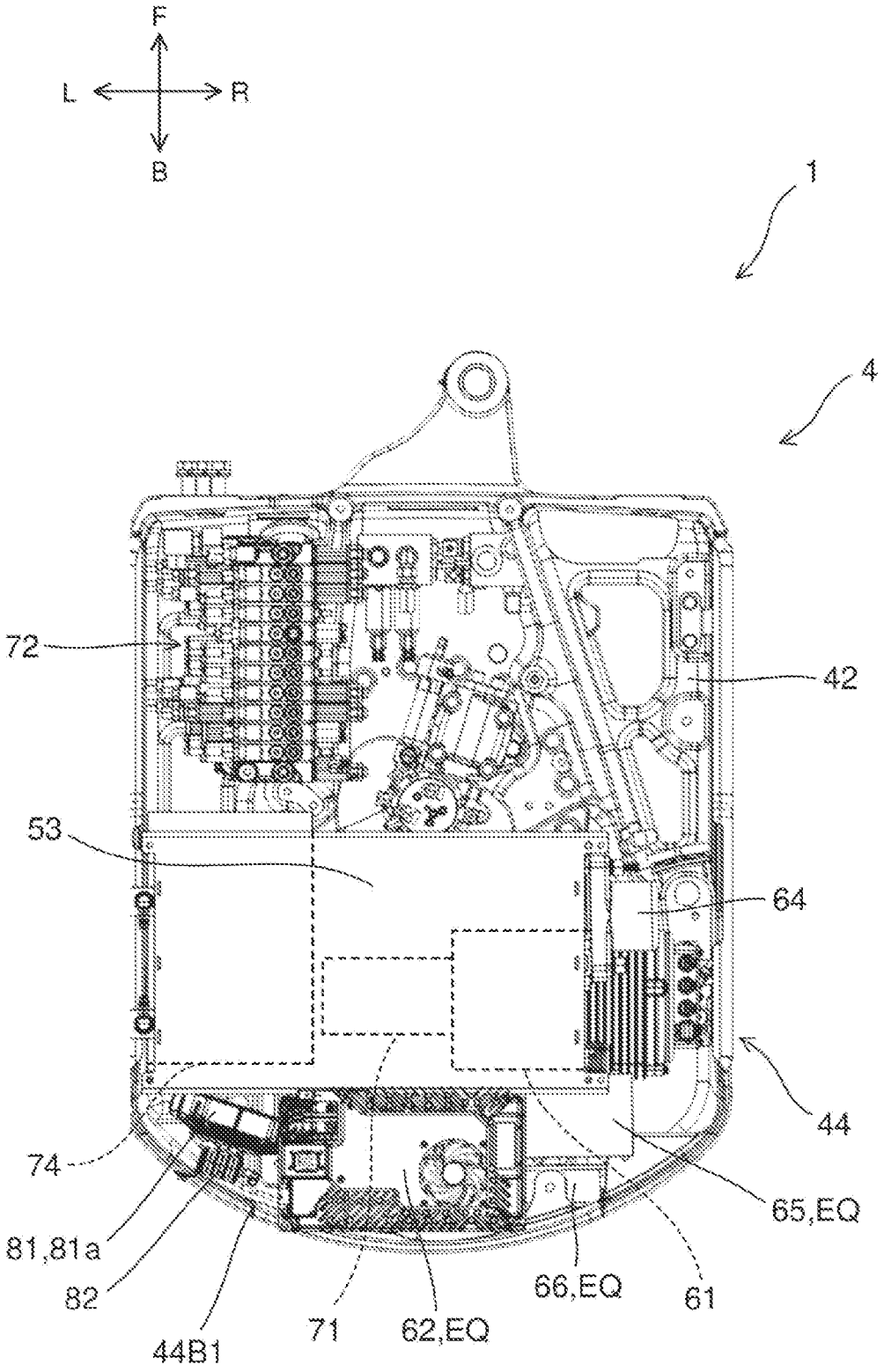
FIG. 4 is a plan view illustrating an internal configuration of an engine room of the above-mentioned hydraulic excavator.
Figure 5:
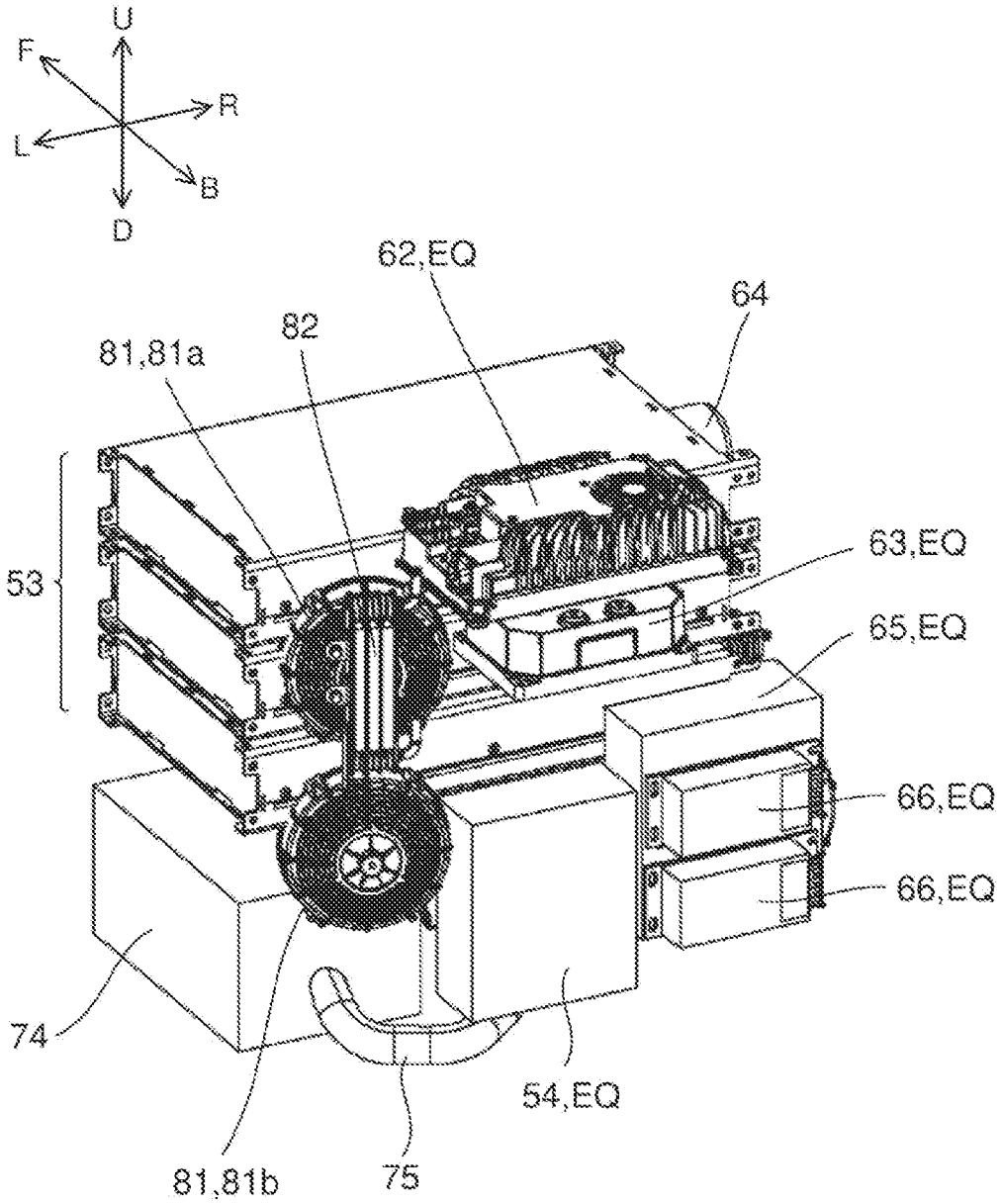
FIG. 5 is a perspective view of an inside of the above-mentioned engine room when viewed obliquely from a rear upper side.
Figure 6:
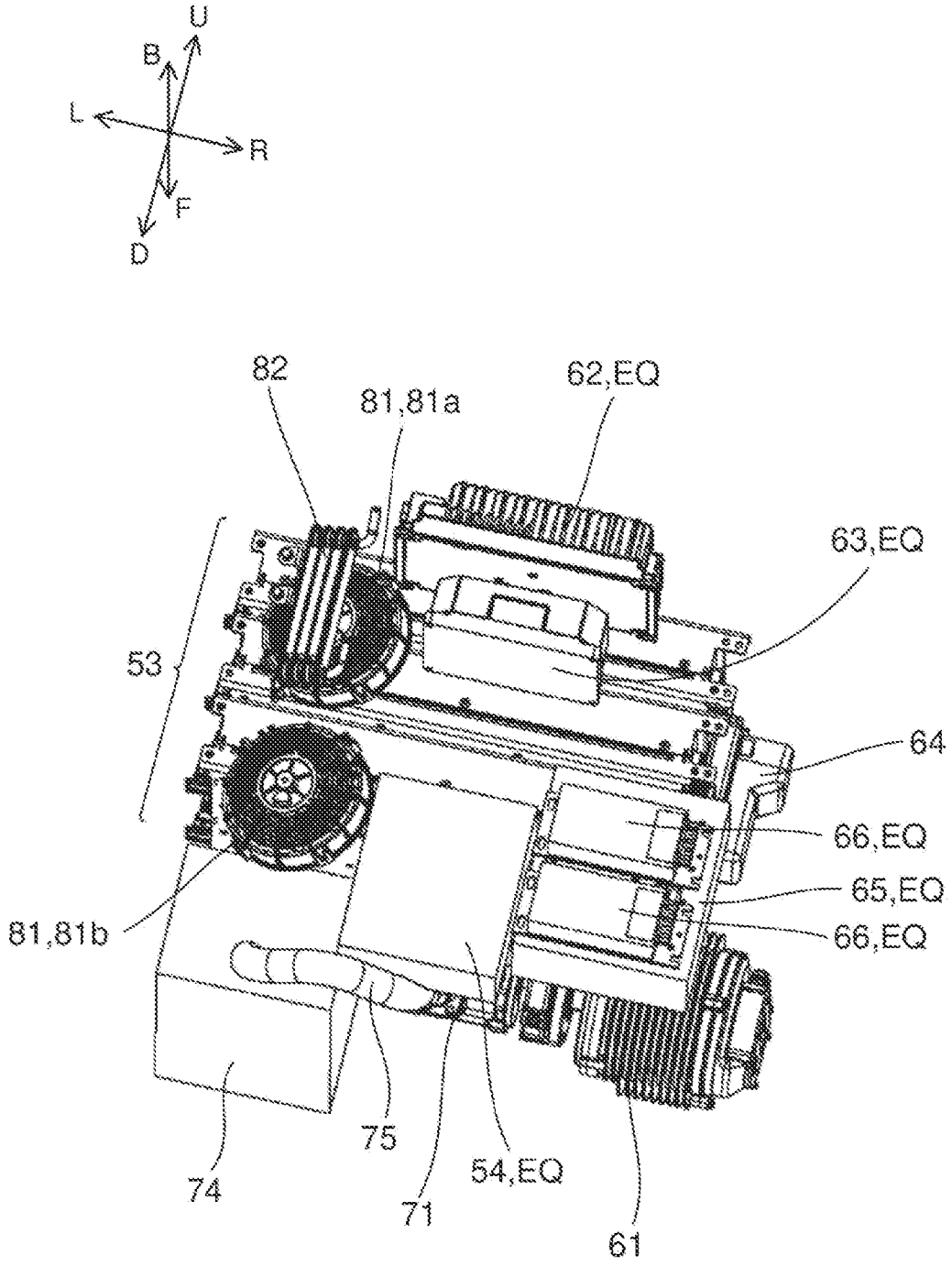
FIG. 6 is a perspective view of an inside of the above-mentioned engine room when viewed obliquely from a rear lower side.

FIG. 4 is a plan view illustrating a configuration of an inside of the engine room 44. FIG. 5 is a perspective view of the inside of the engine room 44 as viewed obliquely from a rear upper side. FIG. 6 is a perspective view of the inside of the engine room 44 as viewed obliquely from a rear lower side. The arrangement of the above-mentioned components in the engine room 44 will be described below. In the engine room 44, each component is supported on the turning frame 22 via a support member such as a stay, but the support member is not illustrated in the drawings for the purpose of clarifying an arrangement position of each component.

As illustrated in FIGS. 4 to 6, the electric motor 61, the hydraulic pump 71, and the hydraulic oil tank 74 are arranged below the battery unit 53 on the turning frame 42. Further, the electric motor 61, the hydraulic pump 71, and the hydraulic oil tank 74 are arranged in this order from a right side to a left side of the turning frame 42 below the battery unit 53. In other words, the electric motor 61, the hydraulic pump 71, and the hydraulic oil tank 74 are arranged side by side in a lateral direction (left-right direction) of the turning frame 42. At this time, the electric motor 61 is arranged on the right side (one side) in the lateral direction, and the hydraulic oil tank 74 is arranged on the left side (another side) in the lateral direction.

The charger 62 is arranged above the turning frame 42 and behind the battery unit 53. The lead battery 54 is arranged above the turning frame 42 and behind the hydraulic pump 71. In other words, the lead battery 54 is arranged even further below the charger 62. The inverter 63 is arranged behind the battery unit 53 and between the charger 62 and the lead battery 54.

The junction box 65 is arranged even further below the inverter 63 and even further behind the electric motor 61. The DC-DC converter 66 is arranged behind the junction box 65. The PDU 64 is arranged on a right side of the battery unit 53 (see FIG. 6).

The fan 81 is arranged in the engine room 44 that contains the battery unit 53. Namely, the hydraulic excavator 1 includes the engine room 44 and the fan 81. The fan 81 is an electric fan, and generates a wind flow in the engine room 44. In the present embodiment, the fan 81 includes a first fan 81*a* and a second fan 81*b*. The first fan 81*a* is arranged behind the battery unit 53. The second fan 81*b* is arranged behind the battery unit 53 and below the first fan 81*a*.

When the fan 81 (the first fan 81*a* and the second fan 81*b*) is driven, air is sucked into the engine room 44 from two vent holes 44R1 and 44R2 (both are second openings; see FIG. 1) provided in a right hood 44R serving as a sidewall on the right side of the engine room 44. The sucked air flows from the right side toward the left side in the engine room 44, and is discharged to the outside through two exhaust ports 44B1 and 44B2 (both are first openings; see FIG. 2) provided in a rear hood 44B serving as a rear wall of the engine room 44. The two vent holes 44R1 and 44R2 are vertically arranged side by side in the right hood 44R. The two exhaust ports 44B1 and 44B2 are vertically arranged side by side in the rear hood 44B, and are arranged facing the first fan 81*a* and the second fan 81*b*, respectively. The right hood 44R is detachably connected to a right end of the rear hood 44B.

The components (including the electric motor 61, the battery unit 53, etc.) arranged in the engine room 44 can be cooled (air-cooled) by the flow of air in the engine room 44.

In the present embodiment, as described above, the electric motor 61, the hydraulic pump 71, and the hydraulic oil tank 74 are arranged below the battery unit 53 on the turning frame 42, and are arranged side by side in the lateral direction of the turning frame 42. Thus, a space below the battery unit 53 on the turning frame 42 can be effectively utilized as a space for arranging the electric motor 61, the hydraulic pump 71, and the hydraulic oil tank 74. Therefore, in the small-sized hydraulic excavator 1, it is possible to achieve a compact layout including the hydraulic oil tank 74 and the battery unit 53, for example, as compared with a configuration in which the hydraulic oil tank 74 is arranged on a side of the battery unit 53.

Further, in the present embodiment, even when the battery unit 53 is increased in capacity (increased in size) in the small-sized hydraulic excavator 1, only the battery unit 53 can be increased in size while the electric motor 61, the hydraulic pump 71, and the hydraulic oil tank 74 are arranged below the battery unit 53. This facilitates an increase in size of the battery unit 53, i.e., an increase in capacity of the battery unit 53, while keeping the layout compact as described above.

Further, even in an assumed case in which the electric motor 61, the hydraulic pump 71, and the hydraulic oil tank 74 are arranged side by side in the lateral direction of the turning frame 42, thereby driving the fan 81 and cooling (air-cooling) the electric motor 61, the hydraulic pump 71, and the hydraulic oil tank 74, the electric motor 61, the hydraulic pump 71, and the hydraulic oil tank 74, which are located below the battery unit 53, can be collectively and efficiently cooled by wind blown in the lateral direction of the turning frame 42.

Therefore, according to the arrangement of the electric motor 61 and the like according to the present embodiment, it is possible to achieve the small-sized hydraulic excavator 1 having a compact layout and capable of facilitating an increase in capacity of the battery unit 53 while taking into consideration a cooling efficiency of the electric motor 61, the hydraulic pump 71, and the hydraulic oil tank 74.

From the viewpoint of cooling the electric motor 61 and the hydraulic oil tank 74 in a well-balanced manner, it is desirable to cool the electric motor 61 having a relatively low temperature first and then cool the hydraulic oil tank 74 having a relatively high temperature by wind blown by the fan 81. For this purpose, it is desirable that the electric motor 61 and the hydraulic oil tank 74 are arranged on opposite sides to each other in the lateral direction on the turning frame 42. In other words, as illustrated in FIG. 4 and the like, the electric motor 61 and the hydraulic oil tank 74 are desirably arranged on one side (for example, the right side) and another side (for example, the left side) in the lateral direction, respectively, on the turning frame 42.

In addition, from the viewpoint of cooling the electric motor 61, the hydraulic pump 71, and the hydraulic oil tank 74 in a well-balanced manner, it is desirable to cool the electric motor 61 having a relatively low temperature first, and then cool the hydraulic pump 71 having a high temperature, and finally cool the hydraulic oil tank 74 having the highest temperature by wind blown by the fan 81. For this purpose, as shown in FIG. 4 and the like, the hydraulic pump 71 is desirably arranged between the electric motor 61 and the hydraulic oil tank 74.

From the viewpoint of avoiding an increase in lateral dimension of the engine room 44 due to the installation of the fan 81, the fan 81 is desirably arranged behind the battery unit 53. In short, it is desirable that the fan 81 be arranged between the battery unit 53 and the rear hood 44B serving as the rear wall of the engine room 44.

In addition, it is desirable that the fan 81 be arranged in the vicinity of the hydraulic oil tank 74 in the engine room 44 from the viewpoint of efficiently cooling the hydraulic oil tank by efficiently making wind hit the hydraulic oil tank 74, which tends to have a high temperature, by driving the fan 81. In this respect, it is desirable that the fan 81 be arranged on a side of the hydraulic oil tank 74 in the lateral direction in the engine room 44. In short, the fan 81 is desirably arranged on another side in the lateral direction in the engine room 44.

From the viewpoint of cooling the electric motor 61, the hydraulic pump 71, and the hydraulic oil tank 74 in this order in a well-balanced manner in the engine room 44, it is desirable to generate a flow of wind from a side of the electric motor 61 toward the hydraulic oil tank 74 side in the engine room 44. For this purpose, it is desirable that, when the fan 81 is driven, air is sucked into the engine room 44 from the vent holes 44R1 and 44R2 (second openings) close to the electric motor 61, and the air is discharged to the outside of the engine room 44 from the exhaust ports 44B1 and 44B2 close to the hydraulic oil tank 74. From this point of view, it is desirable that the exhaust ports 44B1 and 44B2 as the first openings be provided at a position facing the fan 81 in the rear hood 44B serving as the rear wall of the engine room 44. Further, it is desirable that the right hood 44R as a sidewall connected to the rear hood 44B of the engine room 44 and located on one side (for example, the right side) in the lateral direction with respect to the rear hood 44B is provided with the vent holes 44R1 and 44R2 as the second openings.

From the viewpoint of simultaneously and efficiently cooling the battery unit 53, the electric motor 61 arranged below the battery unit 53, and the like, it is desirable to cool the battery unit 53, the electric motor 61, and the like by wind generated by the driving of separate fans 81. In short, it is desirable to cool the battery unit 53 by the wind generated by the driving of the first fan 81*a*. Further, it is desirable to cool the electric motor 61 and the like arranged below the battery unit 53 by the wind generated by the driving of the second fan 81*b* arranged below the first fan 81*a*. Therefore, the fan 81 desirably includes the first fan 81*a* and the second fan 81*b* arranged side by side in the up-down direction in the engine room 44.

In the present embodiment, as illustrated in FIGS. 5 and 6, the hydraulic excavator 1 further includes an oil cooler 82. The oil cooler 82 is a heat exchanger that cools the hydraulic oil by heat exchange, and is arranged in the engine room 44. Further, the oil cooler 82 is connected to a hydraulic oil tank 74 and supplies the cooled hydraulic oil to the hydraulic oil tank 74. It is desirable that the oil cooler 82 be arranged between the fan 81 and the first opening from the viewpoint of making the wind generated in the engine room 44 by the driving of the fan 81 hit the oil cooler 82 and effectively utilizing the wind for cooling the oil cooler 82 and from the viewpoint of efficiently discharging the wind after hitting the oil cooler 82 to the outside via the exhaust ports 44B1 and 44B2 (first openings).

Herein, for example, the wind used for cooling the hydraulic oil tank 74 arranged below the battery unit 53 is increased in temperature by the high-temperature hydraulic oil tank 74. For this reason, when the wind generated by the driving of the second fan 81*b* arranged below hits the oil cooler 82, the wind that has increased in temperature after hitting the hydraulic oil tank 74 hits the oil cooler 82, and there is concern that the cooling efficiency of the oil cooler 82 will decrease.

Therefore, from the viewpoint of efficiently cooling the oil cooler 82, it is desirable to make the wind (having a relatively low temperature) used for cooling the battery unit 53 located above the hydraulic oil tank 74 hit the oil cooler 82. In this respect, it is desirable that the oil cooler 82 be arranged between the first fan 81*a* located at the uppermost part and the first opening (particularly, the exhaust port 44B1).

When the wind generated by the driving of the fan 81 and used for cooling the battery unit 53 and the like in the engine room 44 can be effectively utilized for cooling the electrical equipment EQ (the charger 62, the inverter 63, the junction box 65, the DC-DC converter 66, and the lead battery 54), a fan dedicated to cooling the electrical equipment EQ is not required, which is desirable in that the configuration can be simplified. In this respect, it is desirable that the electrical equipment EQ is arranged on a side (for example, the right side) of the fan 81.

In this case, since the wind generated by the driving of the fan 81 flows against the electrical equipment EQ (hits the electrical equipment EQ or flows along a surface of the electrical equipment EQ) in the engine room 44, the electrical equipment EQ is cooled (air-cooled).

4. Supplementary Description

In the present embodiment, an example in which the electric motor 61, the hydraulic pump 71, and the hydraulic oil tank 74 are arranged in this order from the right side toward the left side in the lateral direction in the engine room 44 has been described, but the components may be arranged in this order from the left side toward the right side in the lateral direction. In other words, one side in the lateral direction may be the left side, and another side in the lateral direction may be the right side. In this case, the arrangement of the components in the lateral direction of the turning frame 42 may be reversed from that in the present embodiment.

The hydraulic excavator 1, which is a construction machine, has been described as the example of the electric work machine in the present embodiment, but the electric work machine is not limited to the hydraulic excavator 1 and may be any other construction machine such as a wheel loader. The electric work machine may be an agricultural machine such as a combine harvester or a tractor.

5. Supplementary Note

The hydraulic excavator 1 described in the present embodiment can also be referred to as an electric work machine as illustrated in the following supplementary notes.

An electric work machine according to supplementary note (1) includes: an electric motor, a battery unit that stores electric power for driving the electric motor; a hydraulic oil tank that contains hydraulic oil; and a hydraulic pump that is driven by the electric motor and connected to the hydraulic oil tank, where the electric motor, the hydraulic pump, and the hydraulic oil tank are arranged below the battery unit on a machine body frame and are arranged side by side in a lateral direction of the machine body frame.

An electric work machine according to supplementary note (2) is the electric work machine according to supplementary note (1), where the electric motor and the hydraulic oil tank are respectively arranged on one side and another side in the lateral direction on the machine body frame.

An electric work machine according to supplementary note (3) is the electric work machine according to supplementary note (2), where the hydraulic pump is arranged between the electric motor and the hydraulic oil tank.

An electric work machine according to supplementary note (4) is the electric work machine according to supplementary note (2) or (3), further including: an engine room that contains the battery unit (and also contains the electric motor and the hydraulic pump); and a fan that generates a flow of wind in the engine room, where the fan is arranged between the battery unit and a rear wall of the engine room.

An electric work machine according to supplementary note (5) is the electric work machine according to supplementary note (4), where the fan is arranged on the another side in the lateral direction in the engine room.

An electric work machine according to supplementary note (6) is the electric work machine according to supplementary note (5), where a first opening is provided at a position facing the fan in the rear wall of the engine room and a second opening is provided in a side wall connected to the rear wall of the engine room and located on one side in the lateral direction with respect to the rear wall.

An electric work machine according to a supplementary note (7) is the electric work machine according to the supplementary note (6), where the fan includes a first fan and a second fan arranged side by side in a vertical direction in the engine room.

An electric work machine according to supplementary note (8) is the electric work machine according to supplementary note (7), where an oil cooler for cooling the hydraulic oil is arranged between the fan and the first opening.

An electric work machine according to supplementary note (9) is the electric work machine according to supplementary note (8), where the oil cooler is arranged between the first fan located at the uppermost part and the first opening.

An electric work machine according to supplementary note (10) is the electric work machine according to any one of supplementary notes (5) to (9), further including electrical equipment arranged on a side (in a lateral direction) of the fan.

Although the embodiment of the present invention has been described above, the scope of the invention is not limited thereto, and can be expanded or modified without deviating from the gist of the present invention.

INDUSTRIAL APPLICABILITY

The present invention is applicable to work machines such as a construction machine and an agricultural machine, for example.

REFERENCE SIGNS LIST

1 Hydraulic excavator (electric work machine)
42 Turning frame (machine body frame)
44 Engine room
44B Rear hood (rear wall)
44B1 Exhaust port (second opening)
44B2 Exhaust port (second opening)
44R Right hood (side wall)
44R1 Vent hole (first opening)
44R2 Vent hole (first opening)
53 Battery unit
54 Lead battery (electrical equipment)
61 Electric motor
62 Charger (electrical equipment)
63 Inverter (electrical equipment)
65 Junction box (electrical equipment)
66 DC-DC converter (electrical equipment)
71 Hydraulic pump
74 Hydraulic oil tank
81 Fan
81*a* First fan
81*b* Second fan
82 Oil cooler
EQ Electrical equipment

The invention claimed is:

1. An electric work machine comprising:
an electric motor;
a battery unit that stores electric power for driving the electric motor;
a hydraulic oil tank that contains hydraulic oil; and
a hydraulic pump that is driven by the electric motor and is connected to the hydraulic oil tank,
wherein the electric motor, the hydraulic pump, and the hydraulic oil tank are arranged below the battery unit on a machine body frame and are arranged side by side in a lateral direction of the machine body frame.

2. The electric work machine according to claim 1, wherein the electric motor is arranged on a first side of the machine body frame and the hydraulic oil tank is arranged on a second side, in the lateral direction on the machine body frame.

3. The electric work machine according to claim 2, wherein the hydraulic pump is arranged between the electric motor and the hydraulic oil tank.

4. The electric work machine according to claim 2, further comprising:
an engine room that contains the battery unit; and
a fan that generates a flow of wind in the engine room, wherein the fan is arranged between the battery unit and a rear wall of the engine room.

5. The electric work machine according to claim 4, wherein the fan is arranged on the second side in the lateral direction in the engine room.

6. The electric work machine according to claim 5, wherein
a first opening is provided at a position facing the fan in the rear wall of the engine room, and
a second opening is provided in a side wall connected to the rear wall of the engine room and located on the first side in the lateral direction with respect to the rear wall.

7. The electric work machine according to claim 6, wherein the fan includes a first fan and a second fan arranged side by side in a vertical direction in the engine room.

8. The electric work machine according to claim 7, wherein an oil cooler for cooling the hydraulic oil is arranged between the fan and the first opening.

9. The electric work machine according to claim 8, wherein the oil cooler is arranged between the first fan and the first opening, wherein the first fan is located at an upper part and above the second fan in the vertical direction.

10. The electric work machine according to claim 5, further comprising electrical equipment arranged toward the first side relative to the fan in the lateral direction.

* * * * *